United States Patent [19]

Haas

[11] Patent Number: 4,489,527

[45] Date of Patent: Dec. 25, 1984

[54] LIFT LANDING DOOR FRAME ARRANGEMENT

[75] Inventor: Max Haas, Kriens, Switzerland

[73] Assignee: Inventio AG, Hergiswil, Switzerland

[21] Appl. No.: 514,923

[22] Filed: Jul. 18, 1983

[30] Foreign Application Priority Data

Aug. 3, 1982 [CH] Switzerland ..... 4672/82

[51] Int. Cl.[3] ..... E06B 1/04

[52] U.S. Cl. ..... 52/217; 52/211; 52/212

[58] Field of Search ..... 52/217, 213, 211, 212; 49/505

[56] References Cited

U.S. PATENT DOCUMENTS

| | | | |
|---|---|---|---|
| 3,535,837 | 10/1970 | Atkinson et al. | 52/217 X |
| 3,686,808 | 8/1972 | Loomis | 52/217 X |
| 3,881,279 | 5/1975 | Kirton | 52/212 X |
| 4,023,326 | 5/1977 | Azuma et al. | 52/217 |
| 4,219,979 | 9/1980 | Wiles et al. | 52/211 X |

*Primary Examiner*—Carl D. Friedman

*Attorney, Agent, or Firm*—Werner W. Kleeman

[57] ABSTRACT

The lift landing door frame arrangement contains horizontally adjustable lateral caulking or sealing elements arranged at uprights of the door frame and a vertically adjustable top caulking or sealing element associated with the topside of the door frame. To avoid retouching due to the caulking elements at the time of placement of the lift landing door frame arrangement and to avoid the formation of gaps in the door frame after placement, each lateral caulking element comprises a rectangular sheet metal panel of a length which exceeds the height of the door frame. Each lateral caulking element engages with and is fixed to the interior of the related upright. Each lateral caulking element is also guided for simultaneous vertical and horizontal adjustment at a guide plate carried by the related upright. The vertically adjustable top caulking element is constituted by a U-shaped sheet metal strap which is disposed astride the front parts of the door frame and is laterally guided thereat. This lift landing door frame arrangement is particularly suitable in cases in which the lift or elevator shaft does not include lateral masonry returns at the landing openings.

9 Claims, 3 Drawing Figures

LIFT LANDING DOOR FRAME ARRANGEMENT

BACKGROUND OF THE INVENTION

The present invention relates to a new and improved construction of lift or elevator landing door frame arrangement.

In its more specific aspects, the present invention concerns a new and improved lift landing door frame arrangement comprising a door frame which contains an upright at each side thereof, a respective horizontally adjustable lateral caulking or sealing element is arranged at each one of the uprights, a vertically adjustable top caulking or sealing element is arranged at the upper or topside of the door frame, said caulking or sealing elements being structured to adapt the door frame to the outline or contour of a landing opening in a lift or elevator shaft.

In order to compensate for relative inaccuracies which, at the time of construction of a building, inevitably occur at the landing openings formed at the lift shaft or chute in order to accommodate the landing doors, it is usual to provide landing openings of sufficient size to permit placement or mounting of a lift landing door frame arrangement. Such lift landing door frame arrangement is usually constituted by a door frame with relatively narrow, laterally finished uprights and at its upper or topside by caulking or sealing elements adaptable to the outline of the related landing opening. Retouching or masonry joinings or joints are thus avoided to a large extent. In numerous cases, such solution is imposed by the fact that, with the aim of lowering the costs of construction and/or achieving standardization, certain architects or contractors refuse to consider lift or elevator shafts including masonry returns at the landing openings as well as performing retouching of the masonry once the landing door frame arrangement has been installed.

In a lift landing door frame arrangement as known, for example, from French Pat. No. 2,120,596, caulking elements are utilized to effect lateral caulking along the height of the door frame, the lateral caulking elements forming two sheet metal elements bent to form a U-shape in cross-section. The caulking elements also partially cover the front surface of the related door frame upright to which the caulking element is associated. At their rear, the caulking elements are connected to the related upright by means of fixing tongues. At its outer edge, each bent sheet metal element is completed by a horizontal adjustable angle iron which can be connected to the rear of the caulking element by means of bolts. A pediment is fixed above an upper crosspiece of the door frame and extends over the entire width of the door frame arrangement. A vertically adjustable caulking plate is arranged at the rear of the pediment. Lateral caulking above the angle irons is effected by means of horizontally adjustable sheet metal squares fixed to the extremities of the pediment.

The known lift landing door frame arrangement has the inconvenience of requiring for the lateral as well as for vertical caulking, the use of different kinds of elements and, consequently, a large number of fixing means. The construction, therefore, is relatively complicated. Another inconvenience is yet based on the fact that unless the pediment and the vertical caulking plate are positionally arranged to adjust for the width of the landing opening in the shaft, gaps will exist in the landing door frame arrangement adjacent the sheet metal squares fixed to the extremities of the pediment. Such gaps, particularly those existing at the junctions of the different caulking elements, must be sealed by connecting elements made of rubber or similar material. Even then, this known lift landing door frame arrangement requires additional measures to satisfy existing regulations in respect of water tightness and fire resistance of lift shafts and landing doors of lifts or elevator equipment which are in force in certain countries. Finally, the narrowness of the visible surface of the angle irons, which arises upon contraction of the bent sheet metal elements forming the lateral caulking elements, may vary from one side of the door frame to the other and/or from one lift landing door frame arrangement to the other and such eye-catching variations have the disadvantage of making the width inaccuracies in the landing openings of the lift shaft clearly stand out.

SUMMARY OF THE INVENTION

Therefore, with the foregoing in mind it is a primary object of the present invention to provide a new and improved lift landing door frame arrangement which is not associated with the aforementioned limitations and drawbacks of the prior art constructions.

Another and more specific object of the present invention aims at providing a new and improved lift landing door frame arrangement which may be readily adapted to the outline or contour of the landing opening formed in the lift shaft or chute without the caulking or sealing element therein requiring retouching or permitting the formation of gaps between the caulking or sealing elements and the door frame of the lift landing door frame arrangement.

Now in order to implement these and still further objects of the invention, which will become more readily apparent as the description proceeds, the lift landing door frame arrangement of the present development is manifested by the features that, each lateral caulking or sealing element is constituted by a rectangular sheet metal panel, the length of which exceeds the height of the door frame and which engages the inside of the related upright. There are also provided guide plates, each of which is carried by a related upright and serve to guide a respective lateral caulking element. Each guide plate contains a number of oblong openings coacting with oblong openings transversely extending with respect thereto in the related sheet metal panel in order to receive and guide fixing bolts for simultaneously vertically and horizontally adjustably fixing each sheet metal panel to the related upright. The top or upper caulking or sealing element associated with the upper or topside of the door frame is constituted by a substantially U-shaped sheet metal strap or bracket disposed astride the front parts of the door frame and having two members or links laterally guided by the door frame.

The advantages achieved by the invention, above all, reside in the simplicity of construction of the lift landing door frame arrangement, which does not require the use of intermediary elements between the actual caulking or sealing elements and the door frame. The placement of the lift landing door frame arrangement according to the invention, notably the adjustment and the attachment of the caulking or sealing elements thereof, is thus substantially facilitated, the more so since the three caulking elements are guided at the door frame uprights or at the front part thereof.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 2:
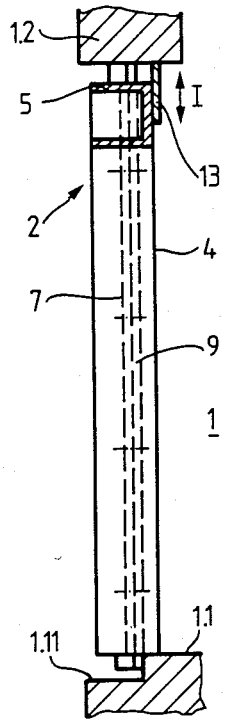
FIG. 2 is a side sectional view, taken substantially along the line A—A in FIG. 1, of the lift landing door frame arrangement shown in such FIG. 1.
Figure 3:
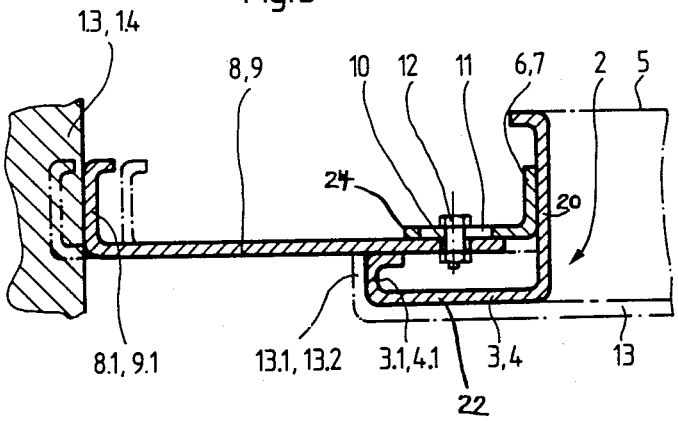
FIG. 3 is a horizontal section, taken substantially along the line B—B in FIG. 1, on an enlarged scale, of the lift landing door frame arrangement shown in FIGS. 1 and 2.

Describing now the drawings, it is to be understood that only enough of the construction of the elevator or lift landing door frame arrangement has been shown as needed for those skilled in the art to readily understand the underlying principles and concepts of the present development, while simplifying the showing of the drawings. Turning attention to the drawings, there has been illustrated therein a lift landing door frame arrangement adaptable to the outline or contour of a landing opening let or formed in a lift shaft or chute at the site of a landing 1 of a building. The landing opening is delimited or bounded by a floor 1.1, a lintel 1.2 and side edges 1.3, 1.4. The floor 1.1 is provided with a usual groove 1.11 or the like to accommodate a support of a door sill (not shown). Reference numeral 2 generally designates the door frame of a landing door which is also not shown. The door frame 2 contains two substantially vertical, parallel uprights 3 and 4. At the upper or topside of the door frame 2, the uprights 3 and 4 are interconnected at their upper ends by a crosspiece 5 or the like. The crosspiece 5 is bent to form a substantially U-shape in cross-section and the legs thereof are directed towards the interior, as shown in FIG. 2. Each upright 3 and 4 is constituted by a plate or plate member which is longitudinally bent in such a manner as to form an L-shape in cross-section, as shown in FIG. 3. One leg of the L-shaped upright 3 and 4 forms a lateral wall 20 at the side of the door. The other leg 22 forms an external or front part and is bent twice at right angles to form returns 3.1, 4.1 directed towards the interior of the related upright 3 and 4, see FIG. 3.

Each one of two angle irons 6 and 7 is appropriately fixed, such as, for example, by welding, to the internal surface of the lateral wall 20 formed by the one leg of the uprights 3 and 4, respectively. The angle irons 6 and 7 extend over the entire height of the associated uprights 3 and 4, and the free members or portions of the angle irons 6 and 7 form guide plates 24 extending in spaced relationship from the related returns 3.1 and 4.1, of the uprights 3 and 4, respectively. The space is sufficient for receiving and guiding associated lateral caulking or sealing elements 8 and 9, to be described more fully hereinafter, at the related uprights 3 and 4.

Each lateral caulking or sealing element is constituted by a substantially rectangular sheet metal panel 8 or 9, respectively. The length of each sheet metal panel 8 and 9 is greater than the height of the door frame 2. The length of the sheet metal panels 8 and 9, however, is smaller than the distance between the base of the groove 1.11 and the lintel 1.2, which distance defines the height of the landing or storey opening in the lift or elevator shaft. The marginal zones or edge regions of the sheet metal panels 8 and 9 which engage the uprights 3 and 4, respectively, comprise substantially vertically extending oblong or elongated openings 10. Further oblong or elongated openings 11 are formed in the guide plates 24 defined by the free ends or legs of the angle irons 6 and 7. The sheet metal panels 8 and 9 are arranged, in the assembled state of the lift landing door frame arrangement as shown in the drawings, in such a way that the oblong openings 10 and 11 extend crosswise or orthogonally with respect to each other and serve as guiding elements or guides for bolts 12 or equivalent fastening expedients which connect the sheet metal panels 8 and 9 to the respective uprights 3 and 4 via the guide plates 24 of the angle irons 6 and 7.

The crosspiece 5 at the upper side or top of the door frame 2 is provided with a top caulking or sealing element **13*a* constituted by a narrow sheet metal band or strap 13 which extends over the entire width of the door frame 2. The two opposite ends 13.1 and 13.2 of the sheet metal band or strap 13 are bent-off essentially at right angles such that this sheet metal band or strap 13 can be positioned adjacent the front part of the door frame 2 and with the bent-off ends or extremities 13.1 and 13.2 contactingly engaging at both sides about the returns 3.1 and 4.1 of such uprights 3 and 4, and equally contacting the sheet metal panels 8 and 9, respectively. The sheet metal band or strap 13 thus assumes the shape of a U-shaped band or strap, the bent-off ends 13.1 and 13.2 of which are laterally guided at the door frame 2 and are vertically adjustable as indicated by the double-headed arrow I of FIG. 2. Once adjusted, the sheet metal strap or band 13 can be fixed by bolts, or by the intermediary of added sheet metal tongues, or any other suitable fixing means (not shown), to the uprights 3 and 4 or to the crosspiece 5. This sheet metal strap or band 13 also can be connected to any other appropriate element fixed to the masonry and to the door frame 2** such as, for example, a crosspiece supporting the landing door.

Figure 1:
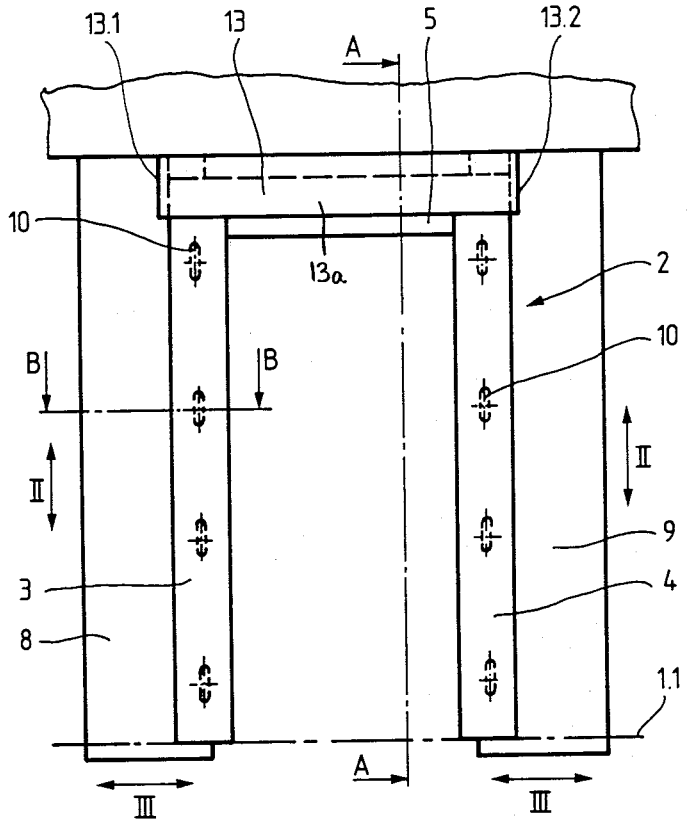
FIG. 1 is a simplified elevational view of a lift landing door frame arrangement constructed according to the present invention and provided with caulking or sealing elements and looking thereat from the landing side.

The substantially rectangular sheet metal panels 8 and 9 are bent-off twice at right angles at their outer marginal zone or edge regions, in order to form the right-angled returns 8.1 and 9.1. On assembly and after the lower ends of the returns 8.1 and 9.1 have engaged in the groove or recess 1.11 and after vertical and horizontal adjustment of the sheet metal panels 8 and 9, respectively, in the direction of the arrows II and III (FIG. 1) has been effected by correspondingly displacing the fixing bolts 12 or the like in the oblong openings 10 and 11, the returns 8.1 and 9.1 can be fixed to the respective lateral edges 1.3 and 1.4 of the shaft opening by using any suitable fixing means like, for example, bolts (not shown).

Within the limits of adjustment permitted by the length of the oblong openings 10 and 11, lateral caulking and a large amount of vertical caulking in the lift landing door frame arrangement as described hereinbefore, is integrally obtained by simply positionally adjusting the sheet metal panels 8 and 9. Any vertical gaps which may still exist at the top of the door frame 2 then can be easily closed by simply vertically displacing the sheet metal strap or band 13, see FIG. 2.

It will be self-evident that, without departing from the scope and spirit of the invention, the uprights of the door frame as well as the crosspiece connecting the same, can be modified and designed in various other ways, notably as a function of the type of landing door involved. For example, instead of being incorporated in the form of a member or part of an angle iron or the like at the uprights, the guiding or guide means for the sheet metal panels may be structured to form integral parts of the uprights. Moreover, depending upon the type of landing door, the sheet metal panels may have different widths for different uprights of the door frame with which they are associated.

While there are shown and described present preferred embodiments of the invention, it is to be distinctly understood that the invention is not limited thereto, but may be otherwise variously embodied and practiced within the scope of the following claims. Accordingly,

What I claim is:

1. A lift landing door frame arrangement comprising:
a door frame intended to be operatively associated with a landing opening in a lift shaft;
said door frame comprising uprights;
a respective horizontally adjustable lateral caulking element arranged at each one of said uprights;
each said lateral caulking element comprising a substantially rectangular sheet metal panel of a length exceeding the height of said door frame;
each said panel engaging its related upright at an inner side thereof;
a respective guide plate provided for each of said uprights and guiding a related one of said panels;
each guide plate possessing a number of oblong openings;
each panel possessing a number of oblong openings;
said oblong openings of said guide plates and said oblong openings of said panels being arranged to extend substantially crosswise with respect to each other in the assembled state of said guide plate and its related panel;
fixing means for horizontally and vertically adjustably connecting each panel to its related guide plate;
a crosspiece arranged at an upper region of said door frame;
a top caulking element arranged at said upper region of said door frame and comprising a substantially U-shaped strap;
said strap being bent at opposite ends thereof to define bent limbs; and
said strap being arranged astride a front part of the door frame and being laterally guided at said door frame by means of said bent limbs.

2. A lift landing door frame arrangement comprising:
a door frame intended to be operatively associated with a landing opening in a lift shaft;
said door frame being provided with a pair of spaced uprights;
lateral caulking elements each arranged at a respective one of said uprights;
means for guiding and releasably fixing each said lateral caulking element at its respective upright for substantially horizontal and vertical displacement;
a top caulking element arranged at an upper region of said door frame;
said top caulking element extending over the entire width of said door frame;
means for guiding said top caulking element at said door frame for vertical adjustment;
said caulking elements being adjustable to adapt said door frame to said landing opening;
each lateral caulking element comprises a sheet material panel having a marginal zone;
said guiding means comprising a guide element provided at each upright;
said marginal zone of each lateral caulking element being releasably fixed and guided at said guide element of its related upright;
said guide element comprises a guide plate extending substantially normally from said upright; and
said marginal zone of said panel being guided at said guide plate.

3. The door frame arrangement as defined in claim 2, wherein:
said guide plate is provided with at least one oblong hole extending transversely with respect to said related upright;
said marginal zone of said panel is provided with at least one oblong hole extending substantially parallel with respect to said upright; and
said panel and said guide plate are arranged, in their assembled state, such that said oblong holes extend substantially orthogonally with respect to one another.

4. The door frame arrangement as defined in claim 3, wherein:
said guiding and releasably fixing means comprise releasable fixing elements extending through said oblong holes.

5. The door frame arrangement as defined in claim 2, further including:
a substantially rectangularly bent-off front part formed at each one of said uprights and provided with a return; and
each said return extending substantially parallel to and in a spaced relationship from said guide plate to accommodate said marginal zone of said panel.

6. The door frame arrangement as defined in claim 5, wherein:
said top caulking element comprises a strap having two opposite ends; and
each said opposite end being guided at a respective one of said uprights.

7. The door frame arrangement as defined in claim 6, wherein:
each said opposite end of said strap being bent so as to at least partially conform to said returns of said uprights; and
said strap being arranged such that said bent ends engage a respective one of said returns of said uprights.

8. The door frame arrangement as defined in claim 6, wherein:
said straps define metal strap members.

9. A lift landing door frame arrangement comprising:
a door frame intended to be operatively associated with a landing opening in a lift shaft;
said door frame being provided with a pair of spaced uprights;
lateral caulking elements each arranged at a respective one of said uprights;
means for guiding and releasably fixing each said lateral caulking element at its respective upright for substantially horizontal and vertical displacement;

a top caulking element arranged at an upper region of said door frame;

said top caulking element extending over the entire width of said door frame;

means for guiding said top caulking element at said door frame for vertical adjustment;

said caulking elements being adjustable to adapt said door frame to said landing opening;

each lateral caulking element comprises a sheet material panel having a marginal zone;

said guiding means comprising a guide element provided at each upright;

said marginal zone of each lateral caulking element being releasably fixed and guided at said guide element of its related upright;

each panel possesses a further marginal zone;

said further marginal zone forming a substantially rectangularly bent-off portion; and said bent-off portion laterally engaging said landing opening.

* * * * *